United States Patent [19]

Maret

[11] 4,111,546

[45] Sep. 5, 1978

[54] ULTRASONIC CLEANING APPARATUS FOR AN ELECTROSTATOGRAPHIC REPRODUCING MACHINE

[75] Inventor: Arthur R. Maret, Roselle, Ill.

[73] Assignee: Xerox Corporation, Stamford, Conn.

[21] Appl. No.: 718,651

[22] Filed: Aug. 26, 1976

[51] Int. Cl.[2] ..... G03G 21/00

[52] U.S. Cl. ..... 355/15; 15/1; 15/256.52; 15/345; 134/1

[58] Field of Search ..... 15/256.51, 256.53, 345, 15/256.52; 134/1; 355/15

[56] References Cited

U.S. PATENT DOCUMENTS

| | | | |
|---|---|---|---|
| T893,001 | 12/1971 | Fisler | 355/15 X |
| 2,858,652 | 11/1958 | Luthman et al. | 134/1 X |
| 3,190,793 | 6/1965 | Starke | 134/1 X |
| 3,552,850 | 1/1971 | Royka et al. | 355/15 |
| 3,668,008 | 6/1972 | Severynse | 355/15 X |
| 3,713,987 | 1/1973 | Low | 195/127 |
| 3,741,157 | 6/1973 | Krause | 15/345 X |
| 4,007,982 | 2/1977 | Stange | 355/15 |
| 4,026,701 | 5/1977 | Till et al. | 355/15 X |

OTHER PUBLICATIONS

J. R. Frederick, "Ultrasonic Engineering," John Wiley & Sons, Inc., 1965, pp. 28-31, 130,131.

*Primary Examiner*—A. D. Pellinen
*Attorney, Agent, or Firm*—James J. Ralabate; Paul Weinstein; William A. Heany, II

[57] ABSTRACT

An electrostatographic reproducing apparatus and process include a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively a conventional mechanical cleaning system is augmented by localized vibration of the imaging surface at the cleaning station which are provided from behind the imaging surface.

5 Claims, 8 Drawing Figures

ULTRASONIC CLEANING APPARATUS FOR AN ELECTROSTATOGRAPHIC REPRODUCING MACHINE

BACKGROUND OF THE INVENTION

This invention relates to a cleaning apparatus for an electrostatographic reproducing machine. The cleaning apparatus utilizes vibratory energy to obtain improved cleaning of the imaging surface of the machine. In particular, this invention is directed to the use of ultrasonic vibrations coupled through an air gap to the imaging surface for removing the residual material. Alternatively, conventional mechanical cleaning is augmented by simultaneously applying vibratory energy from the back of the imaging surface at the cleaning station.

Classical cleaning systems utilized in electrostatographic reproducing machine, for example, use fiber brushes, reverse development, elastomeric blades, webs, etc. These approaches require a strong mechanical coupling between the photoreceptor surface being cleaned and the cleaning device. This can ultimately lead to undesirable effects such as photoreceptor filming or abrasion. Various contactless pneumatic cleaning systems are also known in the art. For example, in U.S. application Ser. No. 552,392, now U.S. Pat. No. 4,026,701 to Till et al, a gas impingement and suction cleaning system is described wherein a gas under pressure is applied to a photosensitive surface to dislodge toner particles thereon and a suction source is utilized to collect and transport away the dislodged toner. Another form of pneumatic cleaning system is described in U.S. application Ser. No. 717,953, now abandoned, filed of even date herewith to Lindblad et al. In the latter system suction alone is utilized to dislodge and collect toner particles from the surface of a photosensitive member. Other pneumatic cleaning systems are described in U.S. Pat. Nos. 3,420,710 to Wollman; 3,615,813 to Clarke; 3,645,618 to Lancia; 3,688,008 to Severynse; 3,741,157 to Krause; and 3,743,540 to Hudson. The Wollman patent shows exposing a web with electrostatically adhering particles thereon to a shock wave created by air directed at at least sonic velocity to dislodge the particles which are carried away at reduced pressure.

It is also known to employ ultrasonic vibratory energy to provide cleaning in electrostatographic reproducing machines. In U.S. Pat. No. 3,483,034 to Ensminger, ultrasonic energy is utilized to remove toner from a photoreceptor surface by employing a liquid coupling between an ultrasonic transducer and the surface. Similarly, Defensive Publication T893001 to Fisler discloses ultrasonic cleaning of a xerographic element utilizing a liquid coupling. When utilizing a liquid coupling cavitation in the liquid occurs under the influence of the ultrasonic vibrations imparted thereto. A cavitation type reaction can cause deleterious effects such as photoreceptor abrasion or damage. Reference is also had to U.S. Pat. Nos. 3,422,479 to Jeffee and 3,635,762 to Ott et al, which show the use of ultrasonic cleaning of film-type webs. In accordance with the present invention an air coupling is provided between the vibratory source and the imaging surface. This is beneficial in reducing damage to the imaging surface while providing good cleaning.

In U.S. Pat. No. 3,617,123 to Emerson, a method and apparatus for cleaning residual toner material is provided wherein a brush is mounted at the entrance to a development-cleaning station and is vibrated to uniformly distribute residual toner over the entire area of the photoconductive surface to improve cleaning. The brush itself does not remove the toner.

In U.S. patent application Ser. No. 547,522, filed Feb. 2, 1975, to Meltzer, a blade cleaning system for an electrostatic reproducing machine is described wherein the blade is rapidly vibrated in a direction parallel to the imaging surface. U.S. patent application Ser. No. 547,523 to Stange, filed Feb. 6, 1975, now U.S. Pat. No. 4,007,982, is also directed to a blade cleaning apparatus for an electrostatographic reproducing machine, however, the blade edge is vibrated at ultrasonic frequencies in a direction parallel to the imaging surface so as to reduce the frictional engagement between the blade and the imaging surface. In these blade cleaning systems there is a mechanical engagement between the vibrating blade edge and the imaging surface.

SUMMARY OF THE INVENTION

This invention is directed to the use of vibratory energy to provide improved cleaning of imaging surfaces in electrostatographic reproducing machines.

In accordance with one embodiment of the invention an electrostatographic reproducing apparatus and process is provided which includes an imaging surface arranged for movement past a plurality of processing means. The processing means include a means for forming an electrostatic image on the imaging surface, a means for developing the electrostatic image to render it visible, a means for transferring the developed image to a sheet of support material, and an ultrasonic cleaning means for removing residual material such as toner from the imaging surface following transfer of the developed image. The ultrasonic cleaning means of this invention includes a member arranged to be vibrated at an ultrasonic frequency. The member has a face position closely adjacent to the imaging surface to define a gap from the face to the surface of less than about 0.03 inches. The gap which is defined comprises an air space between the face of the member and the imaging surface. A means is provided for ultrasonically vibrating the member and the face to excite the air in the gap for removing the residual material from the imaging surface.

The apparatus of this embodiment is a contactless cleaning system wherein the vibratory means is spaced from the imaging surface is there is no mechanical engagement between it and the imaging surface.

Preferably the vibrating member is excited at a frequency of at least 20 KHz and the gap is reduced as much as possible without touching the imaging surface. A particularly useful apparatus in accordance with this embodiment of the invention comprises an ultrasonic horn element for focusing the ultrasonic energy into the gap, and a piezoelectric means for ultrasonically vibrating the horn member. In order to cover an entire imaging surface a plurality of ultrasonic vibrating members and vibratory sources in accordance with this invention are arranged across the surface in a direction transverse to the direction in which it is moving. Preferably, a vacuum system associated with the vibratory member is utilized for collecting the residual material removed from the imaging surface and for transporting it away from that surface.

In accordance with an alternative embodiment of the present invention an electrostatographic reproducing apparatus, as described above, is provided with a pneumatic cleaning system of either the gas impingement and suction type or the suction only type as described in the background of this invention. In accordance with this embodiment of the invention, improved cleaning is provided by simultaneously providing a means in accordance with this invention for applying high intensity ultrasonic vibratory energy to the air space defined between the combined vibratory member and pneumatic cleaning head and the imaging surface. This is accomplished in accordance with a preferred embodiment by providing a pneumatic cleaning port in the vibratory member for either gas impingement or suction only cleaning.

In accordance with yet another embodiment of the present invention, a mechanically coupled cleaning system of any desired type such as brush, blade, web, etc., is utilized and the cleaning action is enhanced by applying vibrations to the back of the imaging surface at the cleaning station.

Accordingly, it is an object of this invention to provide improved cleaning apparatuses and processes for a reproducing machine of the electrostatographic type.

It is a further object of this invention to provide cleaning apparatuses and processes as above which do not engage the imaging surface of the reproducing apparatus.

It is a still further object of this invention to provide cleaning apparatuses and processes as above utilizing ultrasonic frequency vibratory motion coupled to the imaging surface through an air gap.

It is a still further object of this invention to provide cleaning apparatuses and processes for a reproducing machine of the electrostatographic type wherein conventional cleaning is enhanced by imparting vibratory motion to the imaging surface from behind the imaging surface.

These and other objects will become more apparent from the following description and drawings.

DETAILED DESCRIPTION

Figure 1:
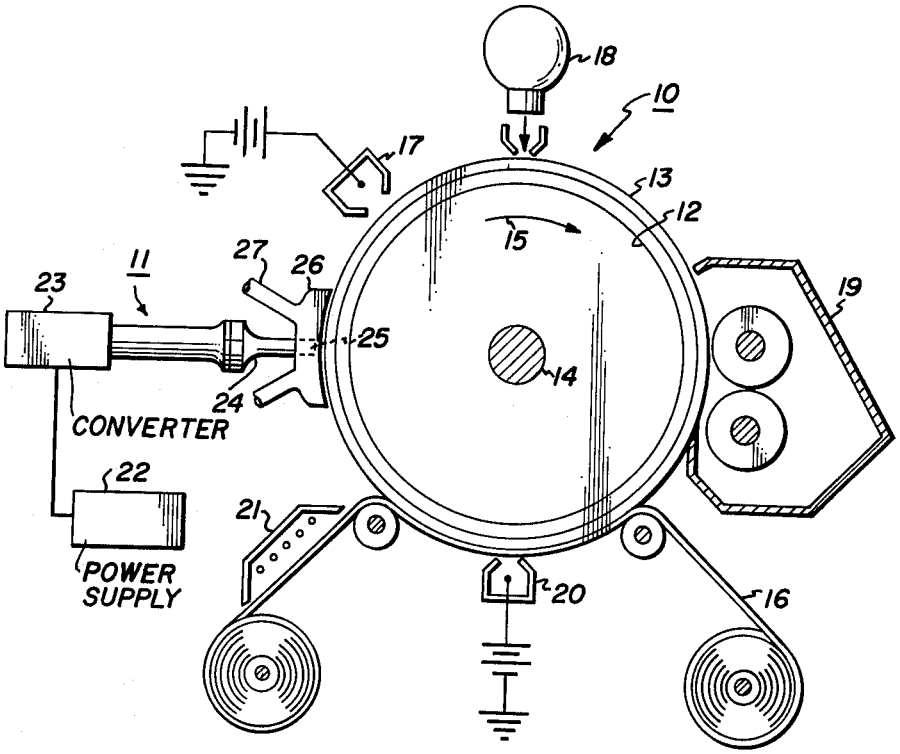
FIG. 1 is a schematic representation of a reproducing apparatus employing a cleaning apparatus of the present invention.

Referring now to FIG. 1 there is shown by way of example an automatic xerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in its application to the particular embodiment or embodiments shown herein.

The reproducing machine 10 illustrated in FIG. 1 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a web or sheet of final support material 16 such as paper or the like.

The practive of xerography is will known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure, drum 12 rotates the electrostatic latent image recorded on the photoconductive surface 13 to development station 19 wherein a conventional developer mix including toner particles is applied to the photoconductive surface 13 rendering the latent image visible as a toner defined image. A suitable development system is described in U.S. Pat. No. 3,707,947, issued to Reichart in 1973.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16 the web with the image thereon is advanced to a suitable fuser 21 which coalesces the transferred powder image thereto. One type of suitable fuser is described in U.S. Pat. No. 2,701,765, issued to Codichini et al. in 1955. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are removed from the photoconductive surface 13 by the use of vibratory energy as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The drum cleaning station 11 is positioned downstream from the transfer station 20 and upstream of the charging station 17. If desired, the removed toner can be returned for reuse to the developer station 19 by any suitable means as are known in the art.

The cleaning apparatus 11 of the present invention includes a power supply 22 of conventional design for providing a high frequency electrical signal. The power supply is connected electrically to a converter 23 which converts the high frequency electrical signal into a high frequency vibratory motion. The converter 23 preferably comprises a conventional ultrasonic transducer employing an active piezoelectric element such as lead zirconate titanate ceramic. The converter 23 is generally adapted to operate at a nominal ultrasonic frequency as, for example, 20 KHz. Mounted to the converter 23 is a vibratory member 24 comprising an ultrasonic horn. The horn is utilized to concentrate the ultrasonic energy and to achieve a proper force amplitude ratio between the face or tip 25 of the horn and the substance being treated.

Illustrative of a power supply 22 converter 23 and horn 24 combination which could be utilized for ultrasonic removal of residual material from the imaging surface of an electrostatographic reproducing machine 10 is the model W-185 SONIFIER cell disrupter distributed by Branson Sonic Power Supply Company, Eagle Road, Danbury, Conn., 06810.

Figure 2:
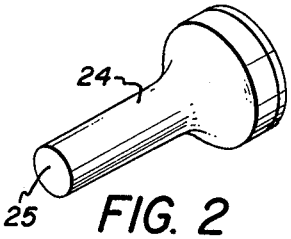
FIG. 2 is a perspective view of an ultrasonic horn in accordance with one embodiment of the present invention.

FIG. 2 shows a perspective view of the ultrasonic horn 24 shown in FIG. 1. The face 25 of the horn which is in opposition to the imaging surface 13 vibrates toward and away from the imaging surface with a total excursion for the Branson device described above of about 0.005 inches. When the ultrasonic cleaning system 11 is in operation, the mechanical vibrations of the horn face 25 or tip set up vibrations in the air space between the tip and the photoconductive surface 13. These ultrasonic vibrations occur in the apparatus shown at a rate of about 20,000 timer per second. The ultrasonic wave traveling through the air space consists of alternate compressions and rarefactions.

In accordance with this invention it has been found critical to place the face 25 of the ultrasonic vibrating member 24 as close as possible to the imaging surface 13 without touching it. It has been found that spacing the face 25 more than 0.050 inches from the imaging surface will result in no cleaning action with the above-described Branson unit. Cleaning is markedly improved as the gap is narrowed from 0.050 to 0.030 inches. Very good cleaning has been obtained at gaps of less than 0.025 inches.

The ultrasonic cleaning apparatus 11 of this invention is particularly adapted for removing particulate type residual material such as toner from a photoconductive surface 11. The particles after being dislodged through the application of ultrasonic energy in the air space between the horn face 25 and the imaging surface 13 are collected and carried away by means of a suction system 26. The suction housing 26 is arranged to surround the ultrasonic horn 24 so that any particles dislodged from the imaging surface are collected and transported away therefrom through pipes 27 which are connected to a conventional vacuum source (not shown). If desired, the particles can then be separated from the suction air stream by any conventional device, as for example, the suction source and cyclone separator described in U.S. Pat. No. 3,793,986, to Latone, and reused in the development system.

The actual mechanism by which the residual toner particles are dislodged from the imaging surface 13 is not totally understood. However, it is believed that the sound field sets the air molecules in the air space between the face 25 of the vibrating horn 24 and the photoconductive surface 13 in motion with amplitudes of several hundred microns and accelerations of up to $10^8$ centimeters per second squared. These molecules of air have high kinetic energy and impact the toner particles to cause their detachment. The direct vibration of the toner particles under the influence of the ultrasonic field aids in detachment by partially negating the forces which hold the particles on the imaging surface 13. Finally, violent collisions between toner particles induced through the aforenoted mechanisms further enhance the cleaning efficiency of the system. While it is believed that the above mechanism is controlling in the apparatus of this invention, it is possible that other mechanisms not fully appreciated may be present.

It is a significant feature of this invention that the ultrasonic energy imparted by the cleaning apparatus 11 is applied principally to the air in the gap between the vibrating horn face 25 and the photoconductive surface 13 and not to the photoconductive surface itself. This results in a substantial lessening of the liklihood of damage to the photoconductive surface, particularly inorganic photoconductors such as vitreous selenium and alloys thereof. It is noted that direct application of ultrasonic energy to a vitreous selenium photoconductive surface could cause it to chip or otherwise be damaged. However, if the gap is greater than about 0.030 inches the excitation of the air molecules at the residual toner particle layer by the face 25 of the vibrating member 24 is not sufficient to cause enough toner detachment for good cleaning of the photoconductive surface.

For purposes of example, a Branson cell disrupter unit as described above was utilized for cleaning toner particles from a moving vitreous selenium photoconductive surface. The ultrasonic horn 24 was similar to that shown in FIGS. 1 and 2 and had a vibratory face one-half inch in diameter. The horn 24 was energized at a frequency of 20 KHz and the tip or vibratory face 25 was placed between 0.015 and 0.030 inches from the photoconductive surface. Using an acoustic power level of about 2–5 watts per centimeter squared at the horn tip/air interface the apparatus successfully cleaned toner particles from the photoconductive surface for imaging surface speeds up to 30 inches per second.

For a system as described by reference to FIG. 1, it has been found that cleaning is optimized when the face 25 of the ultrasonic horn 24 is parallel to the imaging surface 13 or the tangent thereof within about ± 10°.

Figure 3:
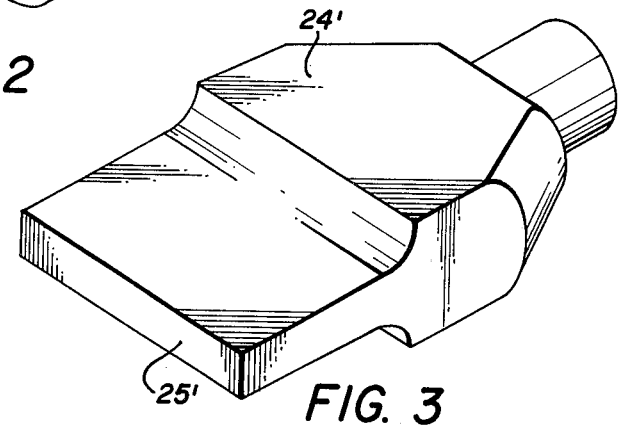
FIG. 3 is a perspective view of an ultrasonic horn in accordance with a different embodiment of the invention.
Figure 4:
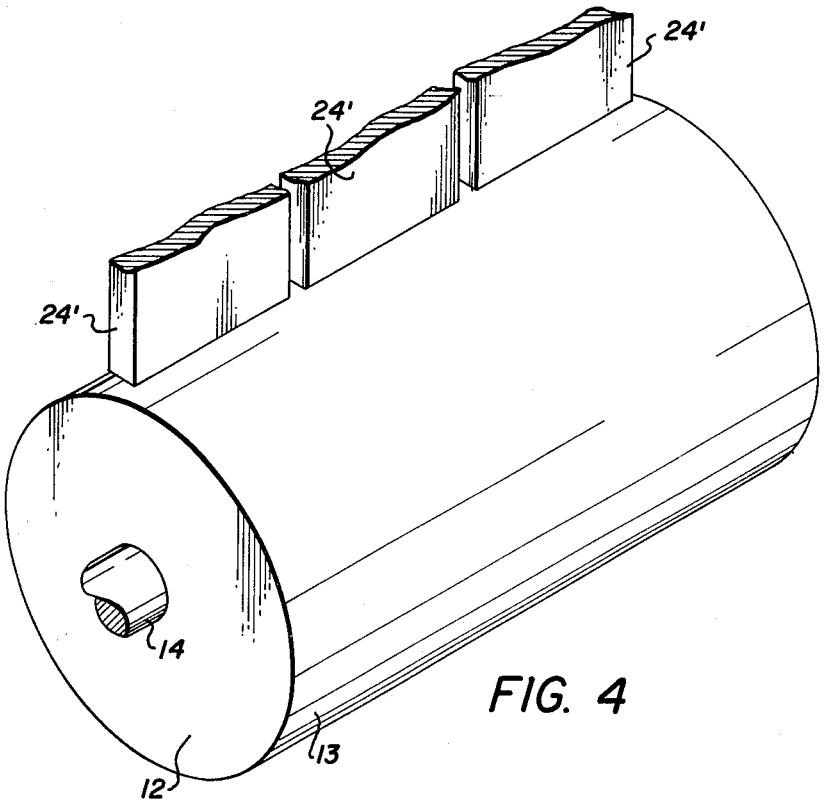
FIG. 4 is a partial perspective view of a reproducing apparatus as in FIG. 1 further showing the use of a plurality of ultrasonic horns.

The axial length of the drum-type imaging member 12 in a conventional electrostatographic reproducing machine will usually vary from about 9 inches to as much as about 15 inches or more. A half inch diameter horn therefor, as shown in FIG. 2, would not be fully effective to remove the residual material from across the entire imaging surface. In place thereof, a blade-type ultrasonic horn, as shown in FIG. 3, could be utilized. The blade-type ultrasonic horn 24' includes a rectangular vibratory face 25' which is positioned in opposition to the imaging surface 13 in the same manner as the cylindrical type horn of FIGS. 1 and 2. The length of the blade may be selected as desired. It would be highly desirable to have a single blade 24' which could extend across the entire imaging surface. It has been found that as the frequency of the vibrations increases the power output at the tip to air gap interface decreases. Further, it has been found that the maximum horn length decreases as the frequency increases. Therefore, it is preferred in accordance with this invention to use a plurality of ultrasonic horns 24', as shown in FIG. 4, which are arranged transversely across the imaging surface 13. For example, in FIG. 4, the drum 12 is fully serviced by means of three rectangular blade-type ultrasonic horns 24'. In the system shown in FIG. 4, the horns are arranged next to one another. Alternatively, if desired, the horns can be arranged in a transversely overlapping arrangement across the imaging surface by staggering them one from another circumferentially of the imaging surface 13.

The apparatus 11 which has been described thus far utilizes ultrasonic vibrations coupled through an air gap for removing toner particles from a photoconductive surface 13.

Figure 5:
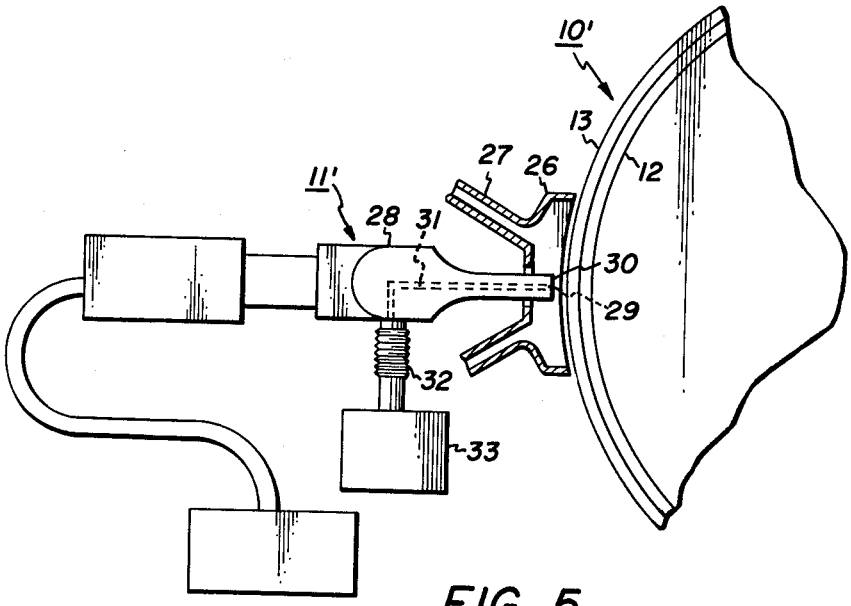
FIG. 5 is a partial schematic view of an ultrasonic cleaning apparatus and reproducing machine in accordance with a different embodiment of the present invention.

Referring now to FIG. 5, a similar apparatus 11' is shown for use as a cleaning system in place of the cleaning apparatus 11 in the electrostatographic reproducing apparatus 10 of the type shown in FIG. 1. The other processing stations 17–21 though not shown would be the same as those described by reference to FIG. 1. They have not been shown for purposes of simplicity. The difference between the cleaning apparatus 11' of FIG. 5, and that described by reference to FIG. 1, is that it is adapted to provide simultaneous ultrasonic cleaning and pneumatic cleaning.

Figure 7:
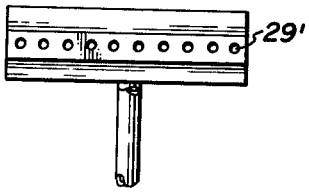
FIG. 7 is a front view of the ultrasonic horn in accordance with an alternative embodiment of the apparatus of FIG. 5.
Figure 6:
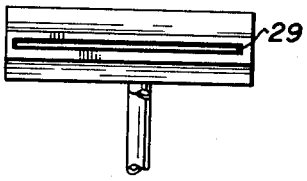
FIG. 6 is a front view of an ultrasonic horn in accordance with one embodiment of the apparatus of FIG. 5.

Pneumatic cleaning as described in the background of this invention can comprise either an air jet and suction type cleaning system as in the Till et al application or a suction only type cleaning system as in the Lindblad et al application. In order to provide simultaneous pneumatic cleaning and ultrasonic cleaning the ultrasonic horn 28 has been modified so that a port 29 or ports 29' are provided in the vibratory face 30 of the horn as shown in FIGS. 6 and 7. A conduit 31 in the ultrasonic horn 28 provides communication via flexible coupling 32 between the port 29 and a source 33 of gas under pressure or of vacuum as desired.

For a gas impingement and suction cleaning approach air under pressure from source 33 would flow through coupling 32 and conduit 31 and issue from the port 29 so as to impinge upon the imaging surface 13 to provide an additional mechanism for removing toner particles therefrom. The source 33 could comprise a compressor. The toner particles, the impinging air and ambient air would then be collected by the suction system 26 surrounding the ultrasonic horn 28 and transported from the imaging surface to a suitable collecting device such as the cyclone separator as described above by reference to the apparatus 11. Preferably the port 29 in accordance with the apparatus of Till et al above is positioned from about 0.003 to about 0.015 inches from the imaging surface 13.

In the alternative embodiment, the conduit 31 from the port 29 is connected to a source 33 of suction via coupling 32. The suction source 33 can comprise any conventional vacuum source such as the one described in the above-identified Latone patent. The suction port 29 is positioned close to the imaging surface and preferably within about 0.003 to about 0.015 inches thereof. The vacuum flow through the port 29 serves to remove toner particles from the imaging surface in the manner of the Lindblad et al application. In addition, the suction system 26 surrounding the ultrasonic horn 28 collects any toner particles dislodged by the combined ultrasonic/pneumatic cleaning system which are not collected by the suction port 29. The advantage of this latter system utilizing suction only in place of gas impingement and suction is a substantial reduction in power consumption.

The vacuum or impingement ports 29 or 29' in the face of the ultrasonic horn 28 comprise, as shown in FIG. 6, an elongated narrow slot or a plurality of individual ports as in FIG. 7. For a gas impingement, the width of the slot 29 or diameter of the port holes 29' should be about three thirty-seconds of an inch, whereas for suction only cleaning, three-sixteenths of an inch would be more appropriate. Further details of the desirable parameters for gas impingement and suction cleaning or suction only cleaning can be obtained by reference to the Till et al. and Lindblad et al. applications described above. While the Till et al. and Lindblad et al. pneumatic cleaning system are preferred for use in this embodiment, any desired suction cleaing system or gas impingement and suction cleaning system could be utilized in conjunction with the apparatus 11' of the present invention to provide simultaneous pneumatic and ultrasonic cleaning.

The cleaning apparatus embodiments which have been described thus far comprise contactless systems wherein there is no mechanical engagement between the imaging surface 13 being cleaned and the cleaning system 11 or 11' since there is an air space between the two. Therefore, the propensity for damage either through abrasion or filming of the photoconductive surface 13 is substantially reduced as compared to mechanical type cleaning systems.

In accordance with a preferred embodiment of the present invention a conventional mechanical type cleaning system such as blade cleaning system of the type described in U.S. Pat. No. 3,660,863, to Gerbasi; or a web type cleaning system of the type described in U.S. Pat. No. 3,099,856, to Eichorn et al; or a magnetic brush type cleaning system of the type described in U.S. Pat. No. 3,580,673, to Yang; or a fiber brush type cleaning system of the type described in U.S. Pat. No. 3,793,986, to Latone, or any other well known cleaning system, is utilized in an electrostatographic reproducing machine 10" for mechanically removing toner particles from a photoconductive or other imaging surface. The cleaning action of any of these conventional cleaning systems is improved by providing localized vibration of the imaging surface 13 at the cleaning station 34 as in FIG. 8. As with the previous embodiment the processing stations 17–21 of the machine 10" are not shown for purposes of simplicity. They would be arranged as in FIG. 1. The imaging surface 13 overlies a supporting drum type member 12 in the apparatus described. Alternatively, the imaging surface support member could comprise a web or belt. It is a unique feature of the present invention that the localized vibration of the imaging surface at the cleaning station 35 is provided by applying the vibrations from the back of the support member 12 at a position in opposition to the cleaning station.

Figure 8:
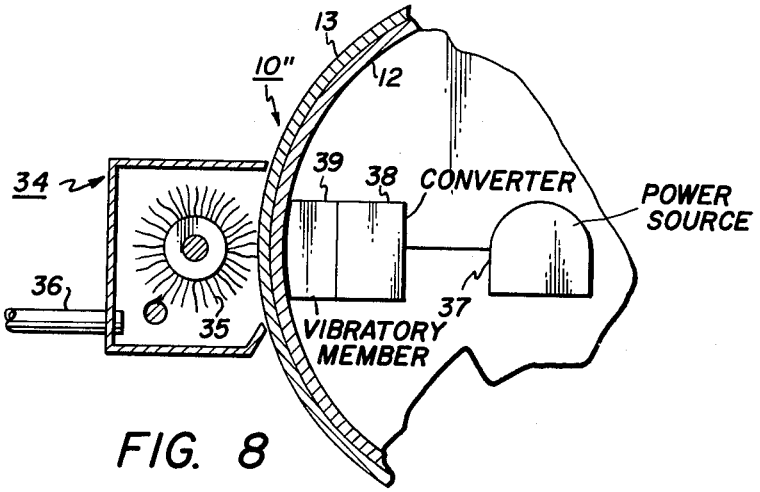
FIG. 8 is a partial schematic view of a cleaning apparatus and reproducing machine in accordance with yet another embodiment of the present invention.

Referring therefor to FIG. 8, a conventional fiber brush cleaner 35 is shown in mechanical engagement with the photoconductive surface 13. Toner particles removed by the brush are flicked therefrom and transported away in a vacuum air flow through pipe 36. The brush cleaning system shown is schematic and any desired system could be used. Internally of the cavity defined by the imaging surface support member 12 and directly opposed to the brush cleaner 35, there is supported in a stationary fashion a power source 37, a converter 38, and a vibratory member 39 similar to the systems described above except that a much wider range of vibrational frequencies can be employed. For example, vibrational frequencies of 60 Hz up to ultrasonic frequencies could be employed. Since there is a mechanical coupling between the imaging surface and the vibrating member 39, the use of very high frequencies could cause damage to an inorganic photoconductive layer such as vitreous selenium or selenium alloy by blasting it off the support member. However, other imaging surfaces such as organic photoconductors might not be easily damaged. Irrespectively, if lower frequencies, for example, 100 Hz are utilized such damage would not occur. The upper limit of vibrational frequency which can be used is, therefore, limited by the resistance of the imaging surface to damage.

In the cleaning system shown, the vibrating member 39 engages the back of the support member 12. There is no air space between the support member 12 as in the previous embodiment and the vibrating member 39. Therefore, there is a direct mechanical coupling between the vibrator 39 and the imaging surface 13. If desired, a lubricant could be employed at the vibrator 39 to drum 12 interface to reduce friction.

The imaging member 12 should have sufficient dampening properties so that the vibrations do not propagate to other processing stations so as to adversely affect image quality. A web type imaging member should be well suited for this embodiment of the invention.

Another suitable vibrator 39 for the embodiment of FIG. 8 is a VB-6C "Vibroblock" manufactured by Arthur G. Russell Co., Inc., Bristol, Connecticut, which operates at a line frequency of 60 hertz to supply a 60 cycle per second vibration as described in the above-identified Meltzer application. The vibrator would be excited by an appropriate A.C. voltage source. Other types of vibratory devices could be employed such as air or fluid actuated types.

While the inventions described above were shown by reference to drum-type imaging surfaces, they are applicable to any desired imaging surface shape such as webs or belts. Preferably the width of a blade-type ultrasonic horn is about one-fourth inch or less and preferably a separate converter is used for each horn in the embodiment of FIG. 4.

The patents and patent applications and texts referred to specifically in this application are intended to be incorporated by reference into the application.

It is apparent that there has been provided in accordance with this invention a cleaning apparatus, process and reproducing apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embract all such alternatives, modifications, and variations as fall within the spirit and broad scope of the appended claims.

What is claimed is:

1. In an electrostatographic reproducing apparatus including an imaging surface arranged for movement past a plurality of processing means; said processing means including: means for forming an electrostatic image on said surface, means for developing said image to render it visible, means for transferring said developed image to a sheet of final support material, and cleaning means for removing residual material remaining on said surface following transfer of said developed image; the improvement wherein said apparatus includes:

means for vibrating said imaging surface as it is acted upon by said cleaning means, said vibrating means being arranged behind said imaging surface at a position in opposition to said cleaning means.

2. An apparatus as in claim 1, wherein said imaging surface defines a cavity, and wherein said vibrating means is supported within said cavity.

3. An apparatus as in claim 2, wherein said imaging surface is supported about a support member and wherein said vibrating means engages said support member.

4. An apparatus as in claim 2, wherein said cleaning means comprises a brush cleaning means for rapidly brushing said surface.

5. An pparatus as in claim 1, wherein said vibrating means provides localized vibration of said imaging surface at said cleaning means.

* * * * *